United States Patent [19]

Todd

[11] 4,164,833

[45] Aug. 21, 1979

[54] SKIP-SEAL MECHANISM FOR PACKAGING MACHINE

[75] Inventor: Henry E. Todd, Cedarburg, Wis.

[73] Assignee: Pratt Manufacturing Corp., Milwaukee, Wis.

[21] Appl. No.: 876,392

[22] Filed: Feb. 9, 1978

[51] Int. Cl.[2] ..... B65B 9/02; B65B 51/14; B65B 51/16; B65B 51/26

[52] U.S. Cl. ..... 53/545; 53/329; 53/373; 156/583.1

[58] Field of Search ..... 53/329, 180 R, 373, 53/545; 156/583

[56] References Cited

U.S. PATENT DOCUMENTS

| | | | |
|---|---|---|---|
| 1,993,442 | 3/1935 | Greven | 53/373 X |
| 3,257,257 | 6/1966 | Karsten et al. | 156/583 X |
| 3,257,939 | 6/1966 | McDermott | 156/583 X |
| 3,484,325 | 12/1969 | Pendleton | 156/583 X |
| 3,522,135 | 7/1970 | Page | 156/583 |
| 3,530,027 | 9/1970 | Nuckols, Jr. | 156/583 X |
| 3,553,930 | 1/1971 | Anderson et al. | 53/373 X |
| 3,846,209 | 11/1974 | Howard | 156/583 X |
| 3,850,780 | 11/1974 | Crawford et al. | 156/583 |
| 3,909,341 | 9/1975 | Moscovita | 156/583 X |

*Primary Examiner*—Horace M. Culver

*Attorney, Agent, or Firm*—Wheeler, Morsell, House & Fuller

[57] ABSTRACT

A machine for heat sealing articles between two continuous webs of plastic material comprises two parallel synchronously driven shafts, each of which has a pair of wheels on it which are brought into pressure relationship for heat sealing. One shaft is mounted for yielding perpendicularly to its rotational axis and carries a cam follower disc. The follower disc is raised intermittently and the seal wheels are thereby separated, to relieve pressure and omit sealing, with a cam that is on the other shaft and is engaged periodically for rotation by means of a clutch.

11 Claims, 7 Drawing Figures

Fig. 1
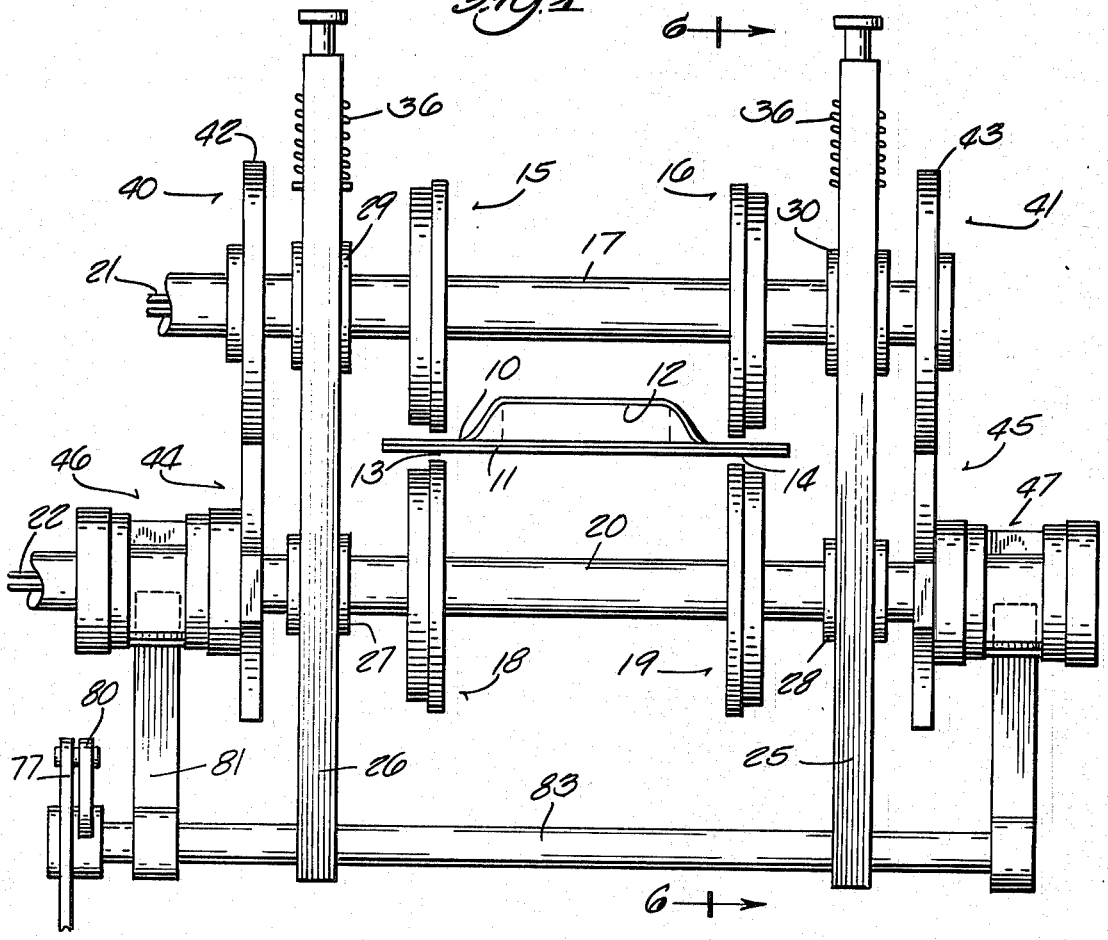
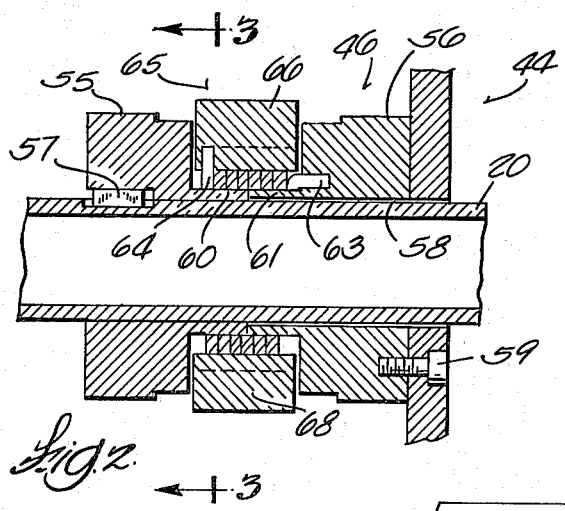
Fig. 2
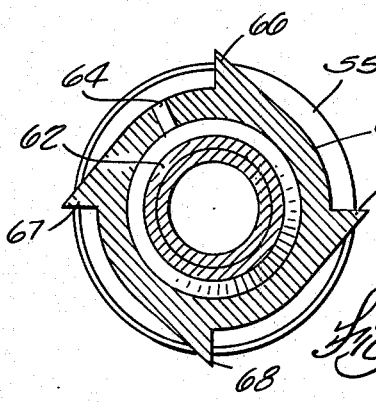
Fig. 3
Fig. 4
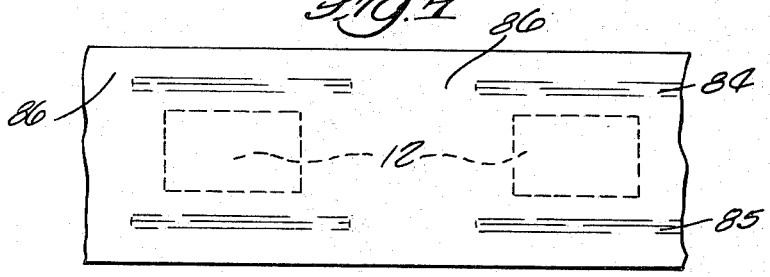

SKIP-SEAL MECHANISM FOR PACKAGING MACHINE

BACKGROUND OF THE INVENTION

This invention is for use in a strip packaging machine which packages articles between two superimposed continuous webs of plastic material and seals the webs together longitudinally or along the outer edges and laterally at spaced intervals to form a series of sealed and isolated compartments for the respective articles. After sealing, the web is divided into separate packages by cutting through some or all of the lateral seals. In some cases, the lateral seals may be omitted in which case the ends of the webs may be secured by retaining them between the laminations of a card on which the individual packages may be mounted.

Machines for sealing articles periodically between two continuously movable webs, using heat, pressure or adhesives or both, are well known. A typical machine is shown in U.S. Pat. No. 2,982,066. It has a pair of pressure sealing wheels on each of two parallel shafts. The wheels on one shaft are substantially tangent to the wheels on the other so that the edges of two superimposed webs may be subjected to pressure as they pass between the wheels for effecting a seal. After the longitudinally extending edge seals are made in this way, lateral seals are made between packages with suitable hot compression devices. In the machine shown in the patent, the longitudinally extending seals are continuous from package to package over the length of the web. On some occasions it is desirable to seal the outside edges and let the ends of the individual packages be free or unsealed in which case it is desirable to skip-seal, that is, to seal the outside edges along the articles being packaged but to skip or omit the seal between articles. The present invention constitutes a mechanism which may be used in a variety of packaging machines to perform skip-sealing.

SUMMARY OF THE INVENTION

The primary object of this invention is to provide a mechanism for producing longitudinally extending seals along the sides of webs enclosing articles and for intermittently omitting seals between said seals.

Other objects are to provide a mechanism that is simple, versatile and accurate.

Another object is to obtain coaction between the parts of the mechanism such that friction and, hence, wear is minimized.

In accordance with the invention, two parallel shafts are journaled in spaced apart supports. Each shaft has pair of axially spaced apart sealing wheels on it. Superimposed webs, between which a series of articles are placed, are moved continuously between the peripheries of the wheels. The peripheries of the wheels in one pair are almost in tangential contact with the peripheries of the other pair of wheels for developing sealing pressure between them. The first shaft is supported for yielding in a direction that is perpendicular to its rotational axis. When the first shaft is urged upwardly, the sealing wheels on it are separated from those on the other and sealing is skipped or omitted. When the first shaft is restored to its lowermost position, pressure is again developed for producing a longitudinal seal.

The first shaft has a circular cam follower disc fastened to it. A radial force applied to the disc causes the first shaft to yield, as mentioned earlier. This force is applied periodically with a multiple lobed cam which is driven by a clutch that is alternately engaged and disengaged from the second shaft which drives it.

How the foregoing and other more specific objects, aspects and advantages of the invention are achieved will be apparent in the more detailed description of an illustrative embodiment of the invention which will now be set forth in reference to the drawings.

DESCRIPTION OF THE DRAWINGS

FIG. 1 is an elevational view of the mechanism for making and omitting seals intermittently;

FIG. 2 is a vertical longitudinal section of a clutch used in the mechanism of FIG. 1;

FIG. 3 is a transverse section taken on a line corresponding with 3—3 in FIG. 2.

FIG. 7 is a plan view of a portion of two webs of plastic material with articles interposed between them and showing longitudinally extending outside edge seals and omission of seals obtainable with the mechanism shown in the previous figures.

DESCRIPTION OF A PREFERRED EMBODIMENT

Figure 6:
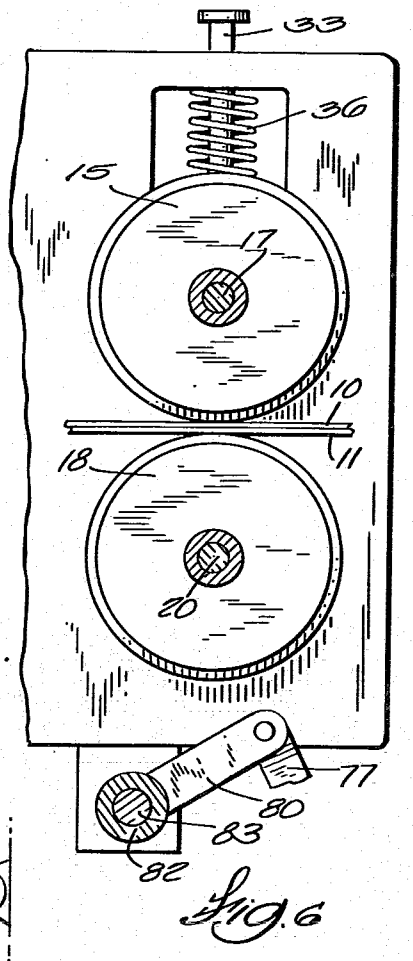
FIG. 6 is a fragmentary vertical section showing one cooperating pair of sealing wheels.

As mentioned earlier, the new skip-seal mechanism shown in the drawings is for use in a packaging machine in which articles are inserted successively between a pair of continuously moving webs or films of plastic or other material and in which the edges of the webs on opposite sides of the articles are sealed together. In such machines as the one shown in U.S. Pat. No. 2,982,066, there is also usually a device for producing lateral seals between individual articles but the present invention is not concerned with that operation. The present invention is for making longitudinally extending seals between webs on both sides of the article and then skipping the seal for some distance between articles.

FIG. 1 shows two webs 10 and 11 which are fed from a pair of reels, not shown, at the input stage of a packaging machine. The webs are assumed to be moving continuously in a plane that is perpendicular to the drawing sheet. With a mechanism that is also not shown, articles 12, shown in phantom lines, are successively inserted between the webs and they create bulges which define the space 12 occupied by an article. Longitudinally extending seals are created on both sides of the article in the regions marked 13 and 14 by subjecting the interfacing webs 10 and 11 to pressure and heat. Typically, the webs are a heat sealable plastic material, such as polyethylene, although other materials can be used including materials treated with heat sensitive adhesives.

Heat and pressure are applied intermittently with upper and lower pairs of sealing wheels. The upper pair, consisting of wheels 15 and 16, are fastened to a shaft 17 and the lower pair, consisting of wheels 18 and 19, are fastened to a shaft 20. The axes of shafts 17 and 20 are parallel to each other and the shafts are driven at a constant rotational speed. The mechanism for driving the shafts synchronously from any available shaft in the packaging machine, not shown, is not illustrated since those skilled in the mechanical arts will know how to implement it. Shafts 17 and 20 may have internal conduits for accommodating conductors 21 and 22 through which current is supplied for energizing the electric resistance heaters, not shown, which are contained within the seal wheels, 15, 16, 18 and 19. Heated sealing wheels are illustrated in U.S. Pat. No. 2,982,066.

Figure 4:
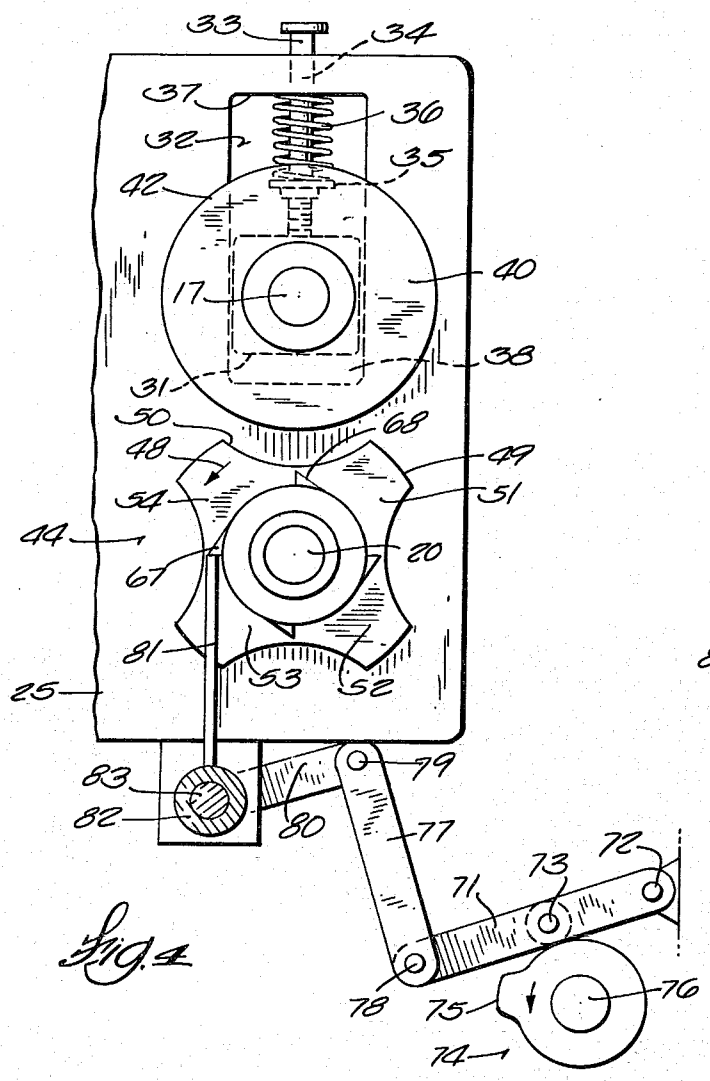
FIG. 4 is a fragmentary side elevational view of the mechanism, showing it in one of its operational phases.

A pair of plate members 25 and 26 constitute the main support for the intermittent sealing mechanism. Lower shaft 20 is journaled in bearings 27 and 28 which are secured in plate members 25 and 26, respectively. Upper shaft 17 is journaled in bearings 29 and 30 but these bearings are not fixed directly in plate members 25 and 26. They are mounted for permitting limited vertical movement of shaft 17. As can be seen in FIG. 4, the bearing for shaft 17 is mounted in a slide block 31 which is disposed and guided in a rectangular opening 32 in plate member 25. In this example, block 31 is urged downwardly in rectangular hole 32 with a pin 33 that passes through a clearance hole 34 in the edge of plate member 25. The pin has a threaded portion on which a nut 35 is screwed. A spring 36 is interposed between the top 37 of rectangular opening 32 and nut 35 for developing the downward force on pin 33. Although block 31 and, hence, shaft 17 and the seal wheels carried on it are biased downwardly by the spring, a gap 38 remains in the bottom of opening 32 since the peripheries of wheels 15, 18 and 16, 19 will be in or near tangential contact before the block strikes the bottom of the opening. Bearing 30, for upper shaft 17, is similarly mounted in a block in its supporting plate member 26. Thus, seal wheels 15 and 16 on shaft 17 are normally biased toward but are yieldable away from the other pair of cooperating seal wheels 18 and 19 on shaft 20.

The shaft biasing means, using a spring, is to be considered illustrative rather than limiting, for various biasing means may be used. For instance, in an actual embodiment, a biasing force is applied to shaft 17 with a pneumatic cylinder, not shown, to permit the pairs of seal wheels on the parallel shafts to separate from each other and to close toward each other as required for making intermittent longitudinally extending seals in the webs.

Refer again to FIGS. 1 & 5 for a more detailed description of how the seal wheels 15 and 16 are lowered and raised intermittently to produce seals on the webs of predetermined lengths and to omit sealing between consecutive side seals. For this purpose, a pair of cam follower discs 40 and 41 are fixed on upper shaft 17 for rotating with the shaft. Their peripheries 42 and 43 are circular. These discs are periodically acted on by a pair of multiple lobe lower cams 44 and 45, respectively. The cam lobes are marked 51–54. Cam 44 is driven selectively by a clutch 46 which intermittently connects cam 44 to lower driven shaft 20. The other lower multiple lobe cam 45 is driven from a clutch 47. During the sealing operation, both clutches are operated in synchronism. In this example, clutches 46 and 47 are identical as are their operating mechanisms so only clutch 46 and its cooperating multiple lobed cam 44 and other associated mechanical components will be described.

Figure 5:
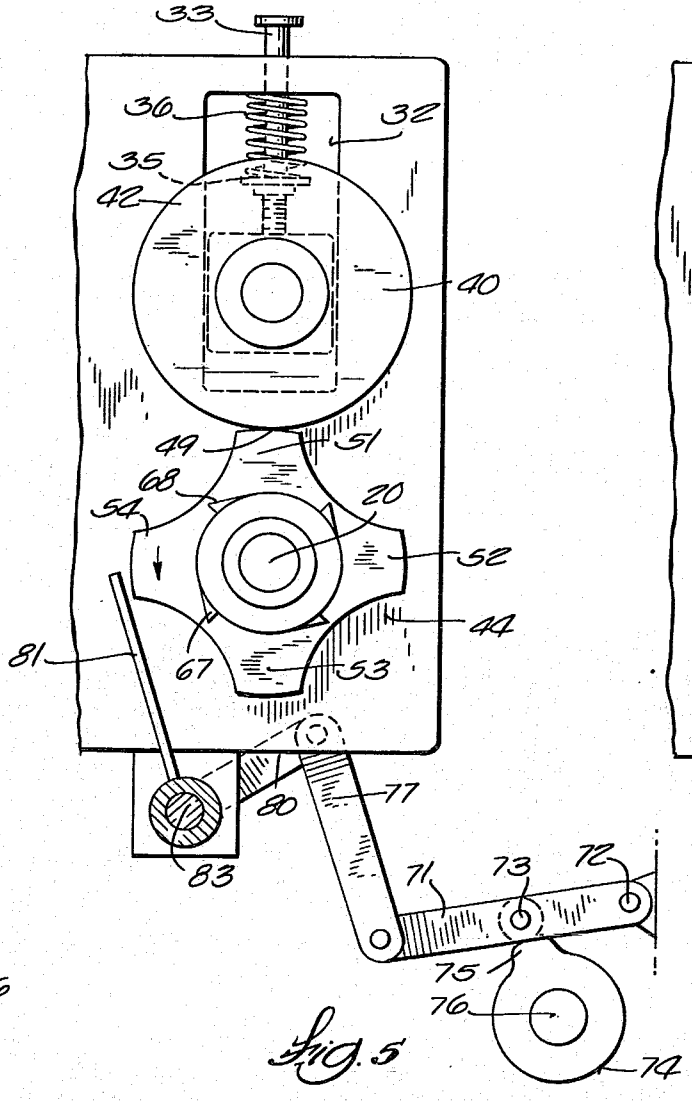
FIG. 5 is similar to FIG. 4 and shows the mechanism in another of its operational phases.

Before describing the clutch structure, attention is invited to FIGS. 4 and 5 for a general description of the operating mode of the skip-seal mechanism. By comparing FIGS. 4 and 5, one may observe that multiple lobe cam 44 is rotatable in the direction of the arrow 48. In this embodiment, lower cam 44 has the four lobes 51 to 54 each of which has a curved periphery such as the one marked 49. The radius of each lobe periphery taken from the center of shaft 20 is substantially the same as the radius of cooperating upper cam follower disc 40 taken from the center of shaft 17. Shafts 17 and 20 are suitably spaced for permitting consecutive lobe peripheries 49 to come into contact with the periphery 42 of upper cam follower disc 40 when the lower cam is indexed rotationally as it has been in FIG. 5. In FIG. 4, upper cam follower disc 40 is aligned with one of the recesses 50 between consecutive lobes of lower cam 44. In FIG. 5, the lower cam 44 has been rotated for the periphery 49 of one of its lobes 51 to contact periphery 42 so that the lower and upper cams 44 and 40 will run together for the length of the curved periphery 49 on each lobe. Under the circumstances in FIG. 5, contact between the lower cam lobe and upper cam follower disc causes the cam follower to be raised in which case upper seal wheels 15 and 16 are also raised and separated from lower seal wheels 18 and 19. Upon this event, the side web seals are skipped. Under the FIG. 4 circumstances, however, the cam lobe periphery 49 is free of cam follower disc 40 and disc 40 together with seal wheels 15 and 16 is allowed to drop down under the influence of biasing spring 36 and produce the side seals on the webs by pressure resulting from the upper seal wheels reacting on the webs which are backed up by the lower seal wheels. It will be evident that the periodicity of seals and skips or omissions can be governed by the number of lobes with which the lower cam 44 and its counterpart cam 45 are provided. The duration of the seals may be controlled by the angle between consecutive lobes and the extent or duration of the skips may be governed by the length of the curved peripheries 49 of the lobes.

As mentioned earlier, multiple lobe cam 44 is driven rotationally and stopped intermittently by engaging it with and disengaging it from shaft 20 with a clutch 46. FIGS. 2 and 3 illustrate the details of one type of clutch which is especially suitable for the purposes described. It is a commercially available mechanically actuated wrap-spring clutch which is well known to those knowledgeable in the mechanical arts. Clutch 46 comprises two axially spaced apart hubs 55 and 56. Hub 55 is fastened to lower shaft 20 with a key 57. Hub 56 has a bore 58 which makes a sliding fit on shaft 20. Multiple lobe cam 44 is fastened to hub 56 with machine screws such as the one marked 59. The reduced diameter ends or axial projections 60 and 61 of hubs 55 and 56, respectively, are surrounded by a helical spring 62 which provides the means for coupling the continuously driven hub 55 with drivable hub 56 which is free on shaft 20. Hub 55 may be considered the power input hub and hub 56 the power output hub. A tang 63 at one end of spring 62 is captured in output hub 56. A tang, called the control tang, 64 extends into a collar 65 which is bored for surrounding the spring. As can be seen in FIGS. 2 and 3, collar 65 has four radially extending stops in this example, marked 66–69. The prestress on spring 62 is such that it tends to wrap tightly around reduced diameter extensions 60 and 61 of the hubs to thus couple hub 55 to hub 56. In this condition, output hub 56 will rotate with driven shaft 20. If collar 65 is turned in a direction that has a tendency to unwind spring 62, the diameter of the spring increases and its gripping effect on hub extensions 60 and 61 is relieved. In this condition, shaft 20 remains free to turn within spring 62, hub 56 and multiple lobe cam 44.

The manner in which the clutch is operated to effect selective contact and separation of seal wheels 15, 16 and 18, 19 for alternately sealing and skipping seals will now be discussed further in reference to FIGS. 4 and 5. The clutch operating mechanism comprises linkage including a link 71 which is on a stationary pivot 72. The link carries a follower roller 73. Link 71 is oscillated by a cam 74 which has a riser 75. The cam is on a shaft 76. Shaft 76, in this illustrative embodiment, is driven by the packaging machine at one revolution per package.

The linkage further includes a link 77 which has pivot connections 78 and 79 at opposite ends. Pivot 79 connects link 74 to one arm of a bell crank comprised of arm 80 and a pawl or control finger 81. The bell crank has a hub 82 that is fastened to a shaft 83 which extends between and is journaled in support plate members 25 and 26 as can be seen in FIG. 1. In FIG. 4, control finger 81 is in engagement with one of the stops 67 on the clutch collar. In this condition, the clutch spring is unwound and shaft 20 is disabled from driving multiple lobe cam 44 rotationally. The follower cam disc 40 is then angularly aligned with a recess 50 between lower cam lobes. Sealing wheels 15 and 16 are then down, as in FIG. 6, to apply pressure and heat on webs 10 and 11 and effect a longitudinally extending seal as illustrated by the seal strips 84 and 85 in FIG. 7.

Eventually, riser 75 on the one revolution per package cam 74 acts on follower 73 such that the bell crank control finger 81 is swung out and released from tooth 67. This liberates the hub for rotation and lets spring 62 wrap around the hub extensions to couple the hubs together to cause multiple lobe cam 44 to begin rotation. As in FIG. 5, the curved periphery 49 of a lobe on cam 44 is thereby driven into engagement with the periphery 42 of cam follower disc 40. Since upper and lower shafts 17 and 20 are now driven together, a rolling action occurs between a cam lobe 51 and the cam follower disc 44 while at the same time shaft 17 is lifted and the seal wheels are separated. By this time, control finger 81 is restored in FIG. 5 to the position it has in FIG. 4 since the riser 75 on the one revolution per package cam 74 has separated from or passed cam follower roller 73. Thus, the multiple lobe cam is driven until the next ensuing collar stop 68 in FIG. 5 strikes the free end of the control finger 81 to thereby release the clutch again and effectuate another seal-skip. A skip is designated by the number 86 in FIG. 7.

Typically, the hub stop 68 might have to be stopped for about 10° of shaft rotation to effect full release of the spring driven clutch. By taking whatever angle is pertinent to a particular clutch into account and by using cams 44 which have various numbers of lobes and selected curved periphery lengths, various combinations of seal lengths and skip lengths may be obtained.

The cam operated clutch actuating linkage described above is merely illustrative for other schemes that can be used. For instance, a solenoid plunger, not shown, may be coupled to link 71 and be energized once per package to obtain periodic release of the clutch stops. In the alternative, a solenoid may be used to actuate a catch finger for directly selectively stopping and disengaging the stops on the clutch hub.

Although the spring actuated clutch described above performs well, it will be appreciated by those skilled in the art that other clutches having the characteristics described above might be substituted for the spring clutch.

Although an embodiment of the new skip-seal control mechanism has been described in considerable detail, such description is intended to be illustrative rather than limiting, for the invention may be variously embodied and is to be limited only by interpretation of the claims which follow.

I claim:

1. A device for producing seals and the absence of seals periodically between superimposed continuously longitudinally moving webs, comprising:

first and second spaced apart rotatably driven shaft means and means for supporting said shaft means, respectively, for rotation, sealing wheel means on each of said shaft means arranged for said webs to pass between them to effect a seal when at least one wheel means is urged toward the other and to omit a seal when said wheel means are separated, means for biasing one shaft means toward the other shaft means to thereby urge a wheel on the one shaft means toward a wheel on the other and produce a longitudinally extending seal, a cam rotatable to apply a force to said one shaft means to thereby separate said sealing wheels when said cam is rotating through certain angular ranges and to relieve said force when said cam is rotated outside of said ranges, clutch means operable sequentially to couple said other shaft with said cam to thereby rotate said cam through one of said certain angular ranges and then to uncouple said shaft and cam after it has rotated through said angular range, and means for controlling said clutch to couple said shaft and cam for an interval corresponding with the space between seals and then to uncouple said shaft and cam for an interval corresponding with the length of a seal.

2. A device for producing longitudinally extending seals and for periodically omitting seals between superimposed continuously longitudinally moving webs, comprising:

first and second spaced apart synchronously driven shaft means, means supporting said second shaft means for rotation on a fixed axis, movable means supporting said first shaft means for rotation about an axis that is parallel to said fixed axis, sealing wheel means on each of said shaft means, said sealing wheel means on one shaft means being aligned with said sealing wheel means on the other shaft means for said webs to pass between them for effecting seals when they are substantially in contact with each other and for omitting seals when they are separated, means for yieldably biasing said movably supported first shaft means and the sealing wheel means thereon toward the sealing wheel means on said second shaft means, circular cam follower means fixed on said first shaft means for rotation therewith, cam means, having a plurality of radially extending and angularly spaced apart lobes, mounted on said second shaft means and arranged for cooperating with said cam follower means, clutch means operative alternately to couple said second shaft means in driving relation with said cam means for said lobes to successively rotate into contact and joint rotation with said follower means to overcome said bias and effect periodic separation of said sealing wheel means and to uncouple said cam means when it has rotated to an angle between lobes to permit the sealing wheel means on said shaft means to move toward the other under the influence of said means for biasing, and means for operating said clutch means.

3. A device for producing pressure effected longitudinally extending seals and for periodically omitting seals between continuously longitudinally moving webs, comprising:

first and second shaft means having their rotational axes in parallel, at least one of said shaft means being movable toward and away from the other, sealing wheel means on said respective shaft means for said webs to pass between them to effect a seal of predetermined length when the preipheries of said wheels are close to each other and to omit a seal when said peripheries are away from each other, means for biasing said first shaft means toward said second shaft means, a circular cam follower fixed coaxially on said first shaft means, a cam on said second shaft means for cooperating with said follower, said cam having a plurality of angularly spaced apart radially extending lobe means each of which has a circular peripheral surface having a radius from the axis of said second shaft means substantially equal to the radius of said follower means, said lobes defining angularly spaced apart recesses between them, clutch means operative to couple said second shaft means in driving relation with said cam to thereby rotate said lobe means successively into contact with said cam follower to cause said first shaft means to move away from said second shaft means and separate said wheel means to effect omission of a seal and operative to uncouple said cam means from said second shaft means when said cam means has rotated to the angle of a recess to thereby permit said first shaft means to move toward the second shaft means to effect a seal, and means for operating said clutch means.

4. The device as in claim 3 wherein:

said clutch means comprises a first part fastened to said second shaft means for rotation therewith and a second part free on said second shaft means and fastened to said cam, a coil spring having opposed ends and surrounding a portion of each part and prestressed to wind into frictional engagement with said parts for coupling them together, collar means rotatable about said spring, one end of said spring being fastened to said collar means and the other end being fastened to said second part, angularly spaced apart stop means extending radially from said collar means for being engaged to cause said collar means to rotate for release of said frictional engagement and for permitting said frictional engagement when said collar means is disengaged, said means for operating said clutch means including means for engaging and disengaging said stop means sequentially.

5. The device as in claim 4 wherein:

said means for engaging and disengaging said stop means comprises a stop element that is movable into and out of the rotational path of said stop means, cyclically operative means for maintaining said element in the path of a stop means to cause unwinding of said spring, for removing said element momentarily to permit said spring to wind and for restoring said element to said path of said stop means for said element to engage the next consecutive stop means and repeat the cycle, whereby to produce a longitudinally extending seal and omission of a seal for each cycle.

6. The device as in claim 5 wherein:

said stop element is a pivotally mounted pawl and said cyclically operative means pivots said pawl at constant intervals to remove it and restore it to the path of said stop means.

7. The device as in claim 5 wherein:

said stop element is a pivotally mounted pawl, said cyclically operative means includes another cam rotating at constant speed and operative to pivot said stop element once for each revolution of said cam.

8. The device as in claim 3 including:

slide block means in which said movable shaft is journaled for rotation, support means having guide means in which said block means slide, said biasing means comprising spring means for applying a force to said slide block means.

9. The device as in claim 3 wherein the predetermined circumferential lengths of the circular peripheral surface on each of said cam lobes controls the lengths of the seal omissions.

10. The device as in claim 3 wherein the predetermined angles between cam lobes which define said recesses controls the lengths of the seals.

11. The device as in claim 3 wherein said means for operating said clutch means includes means for controlling said operating means to operate at constant intervals.

* * * * *